United States Patent [19]

Huston

[11] 4,084,321

[45] Apr. 18, 1978

[54] MASON'S GUIDE

[76] Inventor: Charles W. Huston, 6931 Waterloo Rd., NW., Canal Wilchester, Ohio 43110

[21] Appl. No.: 586,065

[22] Filed: Jun. 11, 1975

[51] Int. Cl.[2] ..... B44D 3/00

[52] U.S. Cl. ..... 33/86

[58] Field of Search ..... 33/85, 86

[56] References Cited

U.S. PATENT DOCUMENTS

| | | | |
|---|---|---|---|
| 2,948,065 | 8/1960 | Simonic | 33/85 |
| 3,436,832 | 4/1969 | Juberigan | 33/86 |
| 3,698,089 | 10/1972 | Huston | 33/86 |
| 3,751,810 | 8/1973 | Valva | 33/86 |

*Primary Examiner*—Richard E. Aegerter
*Assistant Examiner*—John W. Shepperd
*Attorney, Agent, or Firm*—Jerome R. Cox

[57] ABSTRACT

An improved mason's guide for anchoring and positioning an aligning cord. The guide has a clamp element with a pair of adjustable fingers attached thereto, the fingers being designed to affix the guide temporarily to any one of a variety of masonry building units. The aligning cord is secured at one of its ends to a fixed point and at its other end by the cord being wound around one of the adjustable fingers and between the clamp and a convex washer attached thereon. A neoprene sleeve is located on one of the fingers for accurately positioning the aligning cord and allowing the mason's guide to clamp a masonry unit more securely. The guides may also be used to position an aligning cord at a point between its two fixed ends as is required when an obstruction lies in the path of the aligning cord.

3 Claims, 6 Drawing Figures

MASON'S GUIDE

BACKGROUND OF THE INVENTION

1. Field of the Invention

My invention relates to a mason's guide which is utilized to provide means whereby masonry building units such as bricks, cement blocks, etc., may be aligned when they are being laid by a mason. Specifically, the invention is concerned with a mason's guide which may be arranged so that it may be secured to masonry building units for the attachment of an aligning cord thereto. More particularly, the invention relates to an adjustable means for clamping the mason's guide to masonry units and to a means for accurately positioning said aligning cord. Even further, the invention provides for an improved means for gripping the masonry units and means for routing an aligning cord around an obstruction.

2. Description of the Prior Art

Mason's guides have heretofore been provided and my invention relates to an improvement in such guides. The pertinent prior art includes my U.S. Pat. No. 3,698,089, which patent is incorporated by reference in this disclosure. Other prior art is cited or other pertinent prior art is dicussed in my said prior U.S. Pat. No. 3,698,089.

One disadvantage of the prior art is that there is not provided on the mason's guide a surface which readily grips the masonry units.

Another disadvantage of the prior art is that there is not provided a means for guiding an aligning cord around obstacles at positions between the attached ends of the cord. My guide can also be used on a greater variety of masonry units. A typical example of the prior art is Riley U.S. Pat. No. 2,030,539. The device in Riley has a limited adjustability as compared to my improved guide. For use on bricks where there are holes in the brick Riley does not have the ability that my improved guide has to grip the bricks. Riley's device could not be used to anchor an aligning cord.

The ability of the guide of my invention to position an aligning cord accurately by means of a neoprene sleeve represents an improvement in my invention found in Huston U.S. Pat. No. 3,698,089. In addition the neoprene sleeve provides a superior surface for allowing the mason's guide to grip a masonry unit. The use of a collared thumb screw in conjunction with the neoprene sleeve also greatly improves the simplicity of the adjustable fingers.

SUMMARY OF THE INVENTION

The mason's guide of my invention includes one or more clamp elements each having an elongated aperture and each having one or more thumbscrews extending through the aperture. Each thumbscrew is formed with a head and a collar. One end of each screw extends out of the clamp element. On the outwardly extending portion of the thumbscrew there is a neoprene sleeve which serves both to position the aligning cord and to allow the guide to grip a masonry unit better. On at least one of the thumbscrews, there is located a convex washer between the collar and the clamp element. The washer is used to secure an aligning cord. A masonry unit is gripped by the screws and thus the clamp element is secured to the masonry unit. The screws are slidable in the elongated aperture so that they may be spaced at any desired distance and may thus clmp the masonry unit.

It is an object of the invention to provide a device to be used as a mason's guide which is simple in construction, inexpensive to manufacture, and yet effective and effective in use.

A further object is to provide a surface of the mason's guide which will readily grip the masonry units.

A still further object is to provide a means for positioning the associated aligning cord accurately and for guiding the aligning cord around obstructions.

Further objects and features of the invention will be apparent from a reading of the following specification and claims when considered in connection with the accompanying drawings illustrating a preferred embodiment of my invention.

DESCRIPTION OF THE PREFERRED EMBODIMENT

Figure 1:
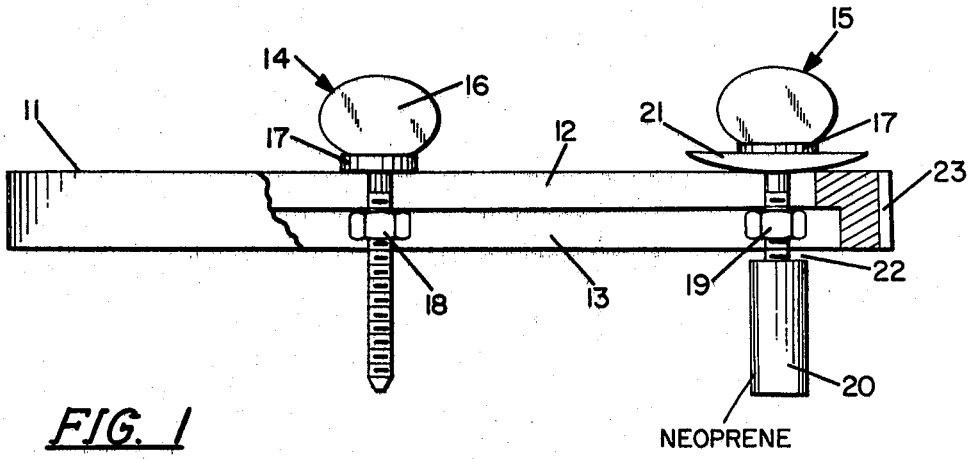
FIG. 1 is a front elevation of one of my mason's guides with part of the clamp element broken away to show the internal structure.
Figure 2:
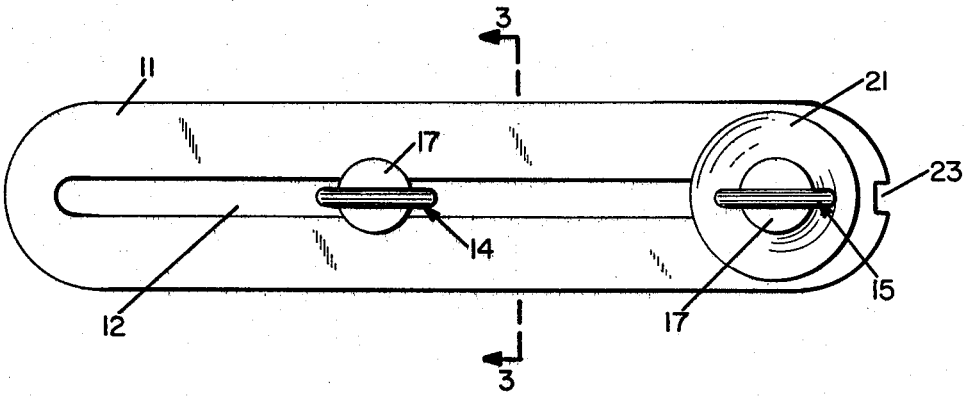
FIG. 2 is a plan view of my mason's guide.
Figure 3:
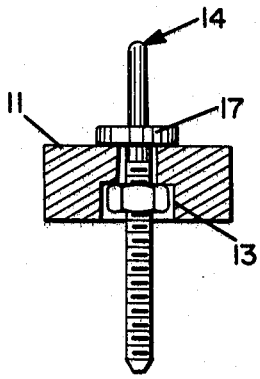
FIG. 3 is a view in section of the mason's guide shown in FIG. 2, taken substantially on the line 3—3 of FIG. 2.

Referring to FIGS. 1, 2 and 3 of the drawings, there is shown a clamp element 11 with an elongated aperture 12. Channel 13 is disposed parallel to and concentric with elongated aperture 12. Disposed within said elongated aperture 12 are thumbscrews 14 and 15. The thumbscrews are typically comprised of an upper flat portion 16 capable of being manually grasped in order to impart rotation thereto. Located below said upper portion 16 is a collar 17 which has an outer diameter large enough that the thumbscrews 14 and 15 are prevented from passing completely through the elongated aperture 12.

Positioned on the thumbscrews on the opposite side of clamp element 11 are nuts 18 and 19 which are located on the threaded portion of thumbscrews 14 and 15 respectively. The outer shape of the nuts is of such a configuration as to prevent rotation of said nuts when disposed within channel 13. The nuts 18 and 19 coact with thumbscrew collars 17 so that the thumbscrews may be constrained within the elongated aperture 12 by virtue of the clamp element 11 being clamped between the collars 17 of thumbscrews 14 and 15 and the nuts 18 and 19 respectively.

A convex washer 21 is situated on thumbscrew 15 between the collar 17 and the clamp element 11. As later shown, this washer is used to secure an aligning cord. Located on the lower portion of thumbscrew 15 is a sleeve 20 which is preferably made of a flexible material such as rubber or neoprene. The sleeve 20 is located relative to the clamp element 11 so as to form a small groove 22 between the sleeve 20 and the clamp element 11 as shown in FIG. 1. On the end of the clamp element 11 is a groove 23 which is utilized to guide an aligning cord.

In use, the clamp element 11 is affixed to a masonry unit by positioning the thumbscrews 14 and 15 so as to clamp either the outer dimension of a masonry or a portion thereof. The thumbscrews 14 and 15 are then rotated to secure them to the clamp element 11, which in turn affixes the clamp element 11 to the masonry unit. An aligning cord is then wrapped around the thumbscrew 15 beneath the convex washer 21 so that the aligning cord is attached to the clamp element 11 by virtue of the aligning cord being wedged between the convex washer 21 and the clamp element 11. The aligning cord is then passed through the groove 23 in the clamp element 11 and around the thumbscrew 15 between the clamp element 11 and the sleeve 20 as shown in FIGS. 4 and 6.

Figure 4:
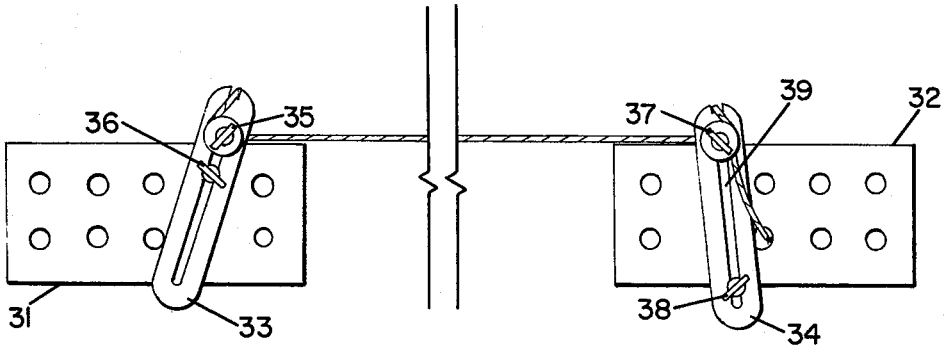
FIG. 4 is a top plan view showing a pair of mason's guides each clamped to a brick and having an alignment cord secured to each guide adjacent to the ends so that the cord provides means for aligning intermediate bricks between the bricks shown in FIG. 4.

Referring to FIG. 4, there is shown a pair of bricks 31 and 32 to which there are affixed clamp elements 33 and 34 respectively. The clamp element 33 is secured to brick 31 by means of two thumbscrews 35 and 36. It should be noted that while the thumbscrew 35 is positioned to contact the upper side of the brick 31, the thumbscrew 36 extends through a hole in the brick. Similarly, the clamp element 34 is secured to the brick 32 by a thumbscrew 37 which bears on the upper side of brick 32 and by a screw which bears on the lower side of the brick 32. It can be seen that the screw 438 has been moved in the elongated aperture 39 of clamp element 34 from a position adjacent to thumbscrew 37 to a position removed therefrom. This illustrates the adjustability of the mason's guide wherein it may be used with masonry units of various sizes and configurations.

Figure 5:
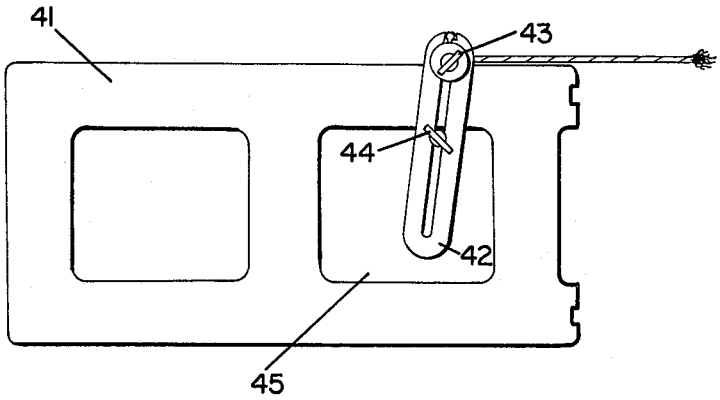
FIG. 5 is a plan view showing my mason's guide attached to a cement block and having an aligning cord extending outwardly along one edge of the block.

In FIG. 5, a cement block 41 has secured thereto a clamp element 42 which has associated therewith a thumbscrew 43 bearing on the top of the cement block 41 and a thumbscrew 44 extending through an opening 45 in the cement block 41 and bearing on an upper surface of the opening 45, thus affixing the clamp element 42 to the cement block 41 in a manner similar to that in which the clamp element 33 is secured to brick 31.

Figure 6:
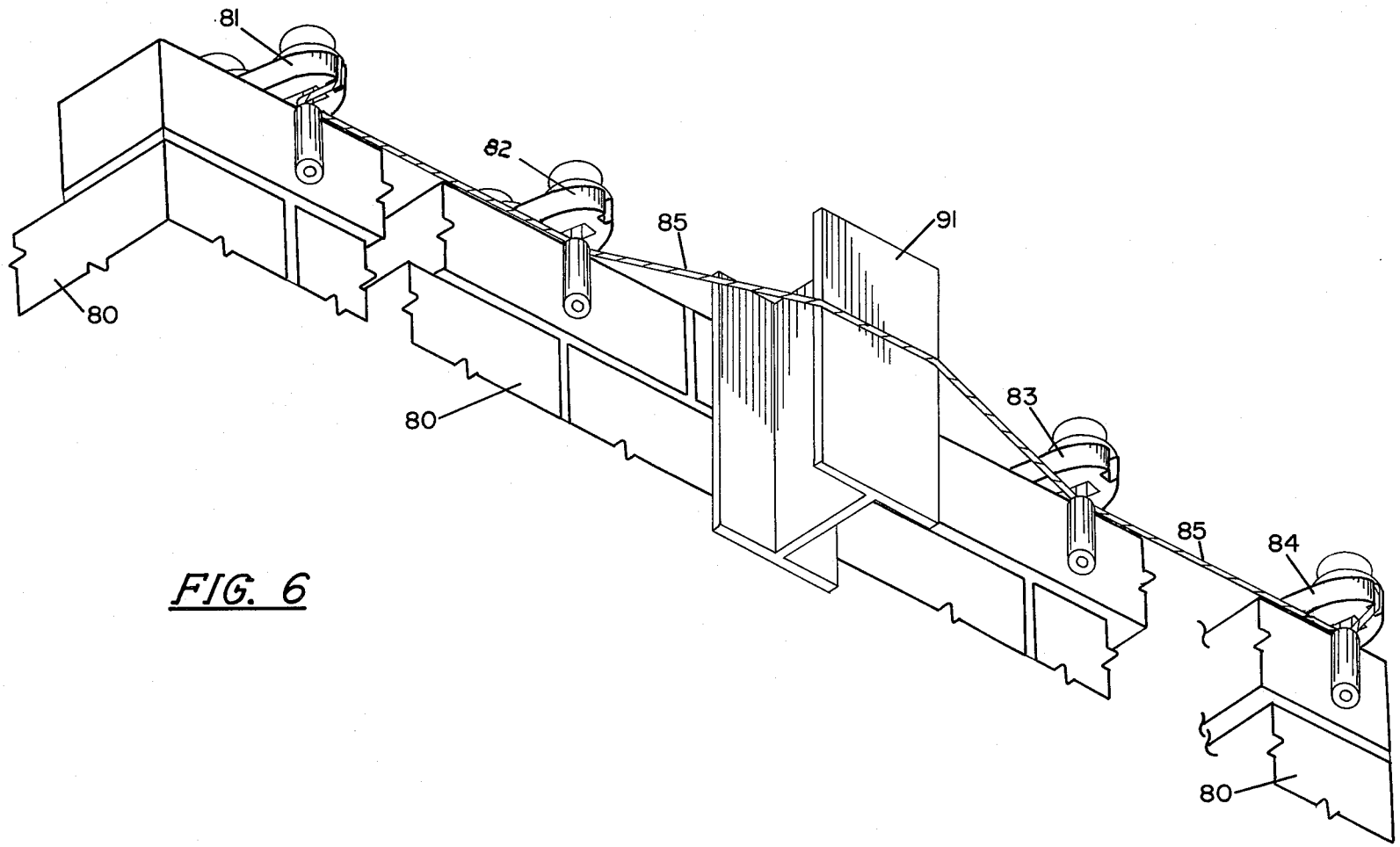
FIG. 6 is a pictorial view showing my mason's guides attached to a masonry wall and guiding an aligning cord around an obstruction.

FIG. 6 illustrates a masonry wall 80 with four of my mason's guides attached thereto, the guides being numbered respectively 81, 82, 83 and 84. Mason's guide 81 has one end of an aligning cord 85 attached to it. The opposite end of the aligning cord 85 is fastened to mason's guide 84 at the other end of masonry wall 80. Mason's guide 82 is attached to the masonry wall 80 at a point between guide 81 and obstructin 91. Likewise, guide 83 is attached to the masonry wall 80 between the obsruction 91 and the guide 84. The guides 82 and 83 are positioned relatively close to the obstruction 91 in order to guide the aligning cord 85 around the obstruction 91.

It is to be understood that clamp elements 33 and 34 of FIG. 4 and clamp element 42 of FIG. 5 are identical with clamp element 11 of FIGS. 1, 2, and 3. It is also to be understood that thumbscrews 35, 36, 37 and 38 of FIG. 4 and thumbscrews 43 and 44 of FIG. 5 are identical with thumbscrews 14 and 15 of FIG. 1, 2, and 3. Nuts such as 18 and 19 are provided for thumbscrews 35, 36, 37, 38, 43 and 44. Washers such as 21 may be provided with any of the thumbscrews as desired.

The guides 81, 82, 83, and 84 are similar to the assemblies including the clamp element 11, the thumbscrews 14 and 15, the nuts 18 and 19, the washer 21 and the sleeve 20.

It is to be understood that while the detailed drawings describe preferred embodiments of my invention, they are for the purpose of illustration only and various changes may be made therein without departing from the spirit of the invention which is defined by the following claims.

I claim:

1. A device for anchoring and positioning an aligning cord, comprising in combination:

(a) a clamp element having an elongated aperture and having a channel parallel with and substantially co-incident in length with said aperture;

(b) two protruding elements each consisting of a screw having a head at one end and each extending slidably through said aperture and each having at least one end formed with external screw threads extending outwardly a substantial distance from said aperture;

(c) retaining means comprising internally threaded nuts acting in cooperation with the external threads of said protruding elements for holding said elements attached to said clamp element while allowing manual positional adjustment of said protruding elements within said aperture;

(d) a cord securing means comprising a convex washer having a centrally disposed aperture positioned on the same end of one of the protruding elements as is the head thereof for securing an aligning cord to the element; and (e) a neoprene sleeve member located on the end of one of the protruding members opposite to the side of said clamp element on which said convex washer is positioned and spaced sightly from said clamp element to provide a space for positioning the aligning cord.

2. A device according to claim 1, wherein the clamp element is formed with a groove for guiding an aligning cord from said convex washer to said space for positioning the cord.

3. In a mason's guide for aiding in aligning building blocks and for securing an aligning cord to said guide and for clamping the guide and the cord to one of said blocks comprising in combination:

(a) a clamp element having an elongated aperture and having a channel parallel with, substantially coincident in length with, and registering with said aperture;

(b) a pair of screws each having a head and each extending slidably through the aperture, having the end opposite to the head threaded externally and extending outwardly a substantial distance from the aperture;

(c) an abutting element comprising a nut threaded on each screw and abutting against one side of the clamp element, said abutting element being of such a size so as to fit non-rotatably in said channel and being slidable longitudinally in said channel;

(d) means comprising a convex washer on the end of one of said screws on the same side of said clamp element as the head of the screw and on the opposite side of the clamp element from said channel for securing a cooperating aligning cord to said clamp element; and (e) a neoprene sleeve member fitting over one of the ends of one of said screws on the side of said clamp element opposite to said convex washer and spaced slightly from said clamp element to provide a space for guiding the cooperating aligning cord.

* * * * *